US010118730B2

(12) United States Patent
Stuermer

(10) Patent No.: US 10,118,730 B2
(45) Date of Patent: Nov. 6, 2018

(54) PLECTRUM AS A LID IN BEVERAGE CANS

(71) Applicant: Hannes Stuermer, Vienna (AT)

(72) Inventor: Hannes Stuermer, Vienna (AT)

( * ) Notice: Subject to any disclaimer, the term of this patent is extended or adjusted under 35 U.S.C. 154(b) by 0 days.

(21) Appl. No.: 15/113,498

(22) PCT Filed: Jan. 14, 2015

(86) PCT No.: PCT/AT2015/050010
§ 371 (c)(1),
(2) Date: Jul. 22, 2016

(87) PCT Pub. No.: WO2015/109349
PCT Pub. Date: Jul. 30, 2015

(65) Prior Publication Data

US 2017/0008666 A1 Jan. 12, 2017

(30) Foreign Application Priority Data

Jan. 27, 2014 (AT) ..... A 50047/2014

(51) Int. Cl.
*B65D 17/00* (2006.01)
*B65D 17/28* (2006.01)
*G10D 3/16* (2006.01)

(52) U.S. Cl.
CPC ..... *B65D 17/4012* (2018.01); *G10D 3/16* (2013.01); *G10D 3/163* (2013.01); *B65D 2517/0041* (2013.01); *B65D 2517/0052* (2013.01); *B65D 2517/0056* (2013.01)

(58) Field of Classification Search
CPC ..... B65D 47/265; B65D 2517/0041; B65D 17/4012; G10D 3/163; G10D 3/16
USPC ..... 220/254.4; 84/320, 322
See application file for complete search history.

(56) References Cited

U.S. PATENT DOCUMENTS 2,484,820 A 10/1949 Galetzky
3,595,118 A 7/1971 Paxton
4,852,763 A * 8/1989 Dimberio ..... B65D 47/265 220/253
5,341,715 A * 8/1994 Hucek ..... G10D 3/163 84/322

(Continued)

FOREIGN PATENT DOCUMENTS

CN 2011-17235 Y 9/2008
DE 295 13 281 U1 4/1996

(Continued)

OTHER PUBLICATIONS

International Search Report of PCT/AT2015/050010, dated May 15, 2015.

(Continued)

*Primary Examiner* — Jeffrey Allen
(74) *Attorney, Agent, or Firm* — Collard & Roe, P.C.

(57) ABSTRACT

The invention relates to a plectrum (1) comprising a flat member (2) that is generally sector-shaped form a top view and has an inner face (3) and an outer face (4) from a top view, the outer face (4) having a larger peripheral size than the inner face (3). The invention is characterized in that the flat member (2) is a single piece, a slot (5) which extends into an opening (6) for a rotary bearing is provided on the inner face (3), and the flat member (2) simultaneously forms a rotatable protective clip-on-part for open beverage cans (8) or the like.

10 Claims, 2 Drawing Sheets

(56) References Cited

U.S. PATENT DOCUMENTS

| | | | | |
|---|---|---|---|---|
| 6,390,749 | B2 | 5/2002 | Song | |
| 6,815,597 | B1 * | 11/2004 | Bosley | G10D 3/163 84/322 |
| 7,459,620 | B1 | 12/2008 | Kester | |
| 8,395,038 | B2 | 3/2013 | Smith | |
| 2002/0108483 | A1 * | 8/2002 | Smith | G10D 3/163 84/322 |
| 2005/0223872 | A1 * | 10/2005 | Greenwald | G10D 3/163 84/322 |

FOREIGN PATENT DOCUMENTS

| | | | |
|---|---|---|---|
| DE | 197 52 038 | A1 | 7/1999 |
| DE | 299 19 689 | U1 | 4/2000 |
| DE | 100 18 685 | C1 | 6/2001 |
| DE | 100 66 012 | C2 | 7/2003 |
| GB | 2 233 141 | A | 1/1991 |
| WO | 2009/130477 | A1 | 10/2009 |

OTHER PUBLICATIONS

Austrian Office Action in A 50047/2014-1, dated Oct. 22, 2014, with English translation of relevant parts.

* cited by examiner

PLECTRUM AS A LID IN BEVERAGE CANS

CROSS REFERENCE TO RELATED APPLICATIONS

This application is the National Stage of PCT/AT2015/050010 filed on Jan. 14,2015 which claims priority under 35 U.S.C. § 119 of Austrian Application No. A 50047/2014 filled on Jan. 27,2014 the disclosure of which is incorporated by reference. The international application under PCT article 21 (2 ) was not published in English.

The invention relates to a plectrum having a fiat member generally in the shape of a sector in top view, which comprises an inner face as well as an outer face with a larger peripheral extent than the inner face in top view.

A plectrum, also known as a pick, is used to strike or strum strings of stringed instruments, in particular guitars. A plectrum which is generally triangular in top view with variable thicknesses for playing a guitar is known from CN 2011-17235.

A plectrum as described above is also known from U.S. Pat. No. 8,395,038 B2. That plectrum has a flat member formed from a plastic material and, on the borders of the flat member which come into contact with the strings of the respective instrument, a metallic insert is provided which protrudes beyond the edge of the plastic flat member. This is intended to produce on the one hand a good sound quality, and on the other hand a long service life, i.e. a reduction in wear of the plectrum. However, manufacture of a plectrum of that type is clearly complicated.

U.S. Pat. No. 2,484,820 describes a plectrum which comprises tooth-like projections for playing strings; in preferred embodiments, these teeth project from a member which is triangular in shape, wherein slotted openings are provided between adjacent, teeth, which openings lead into circular recesses. In this manner, the tooth-like projections are particularly flexible, but they can be broken off relatively easily.

DE 295 13 281 U1 describes a plectrum which also comprises a striking region with tooth-like projections with which the strings of a stringed instrument are struck. Because the projections end in a point, there is a risk of rapid wear or breakage of the projections.

U.S. Pat. No. 4,852,763 A discloses a disk-shaped cover for a beverage can which preferably consists of a flexible plastic. The cover is in the shape of a circular sector and comprises a central opening which is accessible from the exterior. The diameter of the disk corresponds to the diameter of the circular top of the can on which the drinking opening is located. DE 29919689 U1 discloses a similar rotatable covering disk for a beverage can, however it has several recesses, namely a large recess to expose a central bearing opening, a drinking recess, an air hole as well as a drinking straw recess. Because of the size and shape, this cover has only one practical application, namely to close off the beverage can.

The aim of the invention is to provide a plectrum which not only is easy to produce and provides for a good sound quality, but moreover, has a novel addition function.

Accordingly, the invention provides a plectrum having a flat member generally in the shape of a sector in top view, which comprises an inner face as well as an outer face with a larger peripheral extent than the inner face in top view, and is characterized in that a slotted opening is provided on the inner face which leads into a pivot bearing opening, and in that the flat member simultaneously forms a pluggable rotatable protective part for open beverage cans or the like.

The present plectrum with the one-piece flat member can easily be manufactured from plastic, for example by injection moulding; by providing said pivot bearing opening, the plectrum can be attached to conventional beverage cans with a top drinking opening which can be torn open with the aid of a pull tab; as a rule, the pull tab in this case is fixed to the top of the beverage can with the aid of a short cylindrical peg, and the present plectrum is attached laterally to this peg by pushing, whereupon the peg passes through the slotted opening into the pivot bearing opening.

It should be mentioned that in connection with a plectrum, it is already known to provide an opening on one face, but in known embodiments of plectrums this opening has always been on the broader side and simply acts to push the plectrum onto a string or a peg; see, for example., U.S. Pat. No. 6,815 597 B1, GB 2 233 141 A, U.S. Pat. No. 3,595,118 or U.S. Pat. No. 7,459,620 B1.

On the other hand, rotatable disk-shaped protective covers for conventional beverage cans are known per se; see, for example, DE 100 18 685 C2 or DE 19752038 A1. These known protective covers, which act to temporarily cover the drinking opening of a beverage can following opening of the beverage can to prevent the ingress of debris, especially insects such as wasps, are as a rule generally circular in top view, matching the top of a conventional cylindrical aluminium beverage can. These known protective covers would thus not be suitable for use as a plectrum. On the other hand, investigations carried out in respect of the present invention have shown that with a flat member which is generally in the form of a circular sector in top view which is suitable for use as a plectrum, the desired function of protecting opened beverage cans can also be provided without any problems.

In order to adjust it to the cylindrical member, i.e. to the cylindrical border of the beverage can, the outer face of the flat member is advantageously in the shape of a circular arc in top view.

In order to snap the flat member of the plectrum easily onto the peg mentioned above for fixing the pull tab on beverage cans, the slotted opening preferably leads into the pivot bearing opening via a constriction in order to snap-fit it to a beverage can.

Advantageously again, the pivot bearing opening comprises a border which is approximately semi-circular in shape.

In order to attach the flat member to the peg, it is also advantageous when the slotted opening comprises lateral borders which run front the pivot bearing opening to the border of the inner face of the flat member in diverging or parallel lines.

In order on the one hand to be able to use the plectrum when playing a stringed instrument in a manner such that the two limbs either side of the slotted opening come into contact with strings and thus provide sufficient stability, and on the other hand to ensure stable attachment of the plectrum to the beverage can without risking breakage of the limb which is formed, advantageously, the outer face and the inner face of the flat member are connected via lateral borders which are deflected outwards at an angle in the region of the pivot bearing opening, so that the limbs are enlarged in width.

In order to play in different manners, it is also of advantage when the flat member is a part formed from two materials with different hardnesses, in particular an injection moulded part.

In this regard, in order to play it in the desired manner, it has been shown to be advantageous when a dividing line is provided between the two materials which runs from one lateral border to the outer face at an inclination.

Having regard to producing a good compromise between use as a plectrum on the one hand and use as a protective cover on the other hand, it is also of advantage when the flat member corresponds in top view to a generally circular sector with a sector angle between 60° and 90°.

In order to play with the plectrum, it may also be of advantage when the flat member comprises at least two different thicknesses, again in order to obtain different degrees of hardness in a one-piece flat member material.

The invention will now be described in more detail with the aid of particularly preferred exemplary embodiments which are, however, non-limiting in scope, and made with, reference to the accompanying drawings.

Figure 3B:
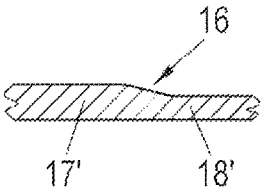
Figure 2:
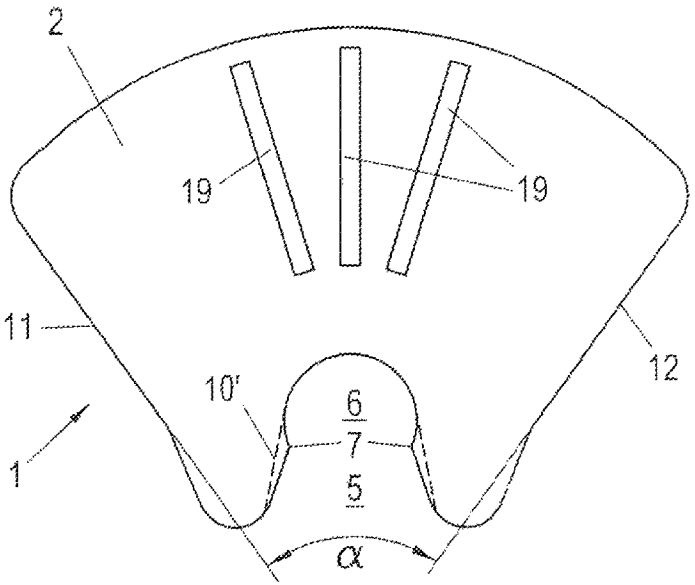
FIG. 2 shows a top view of a further embodiment of a plectrum of this type.
Figure 3A:
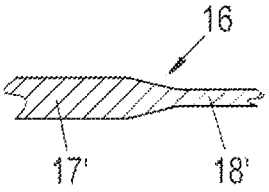
Figure 1:
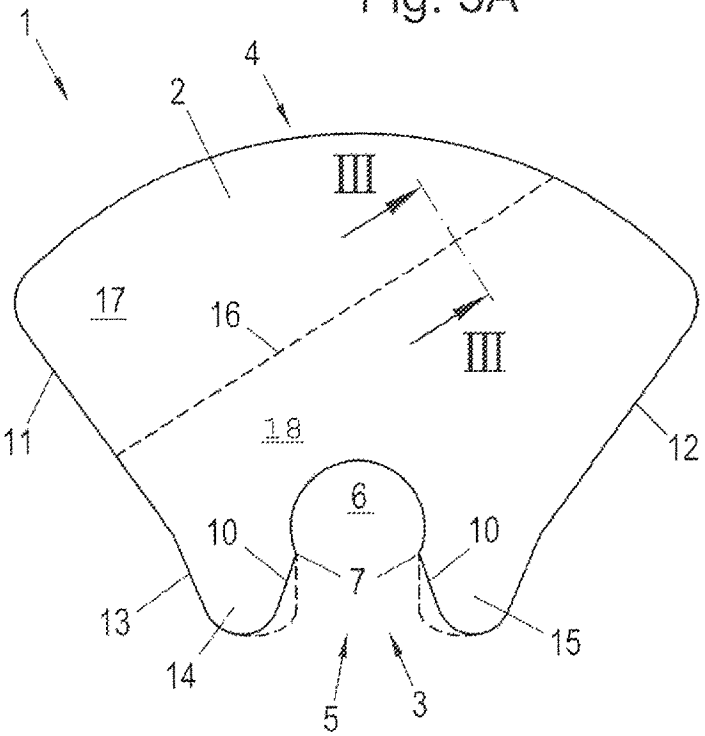
FIG. 1 shows a top view of a plectrum, in accordance with a first embodiment of the invention.
Figure 4:
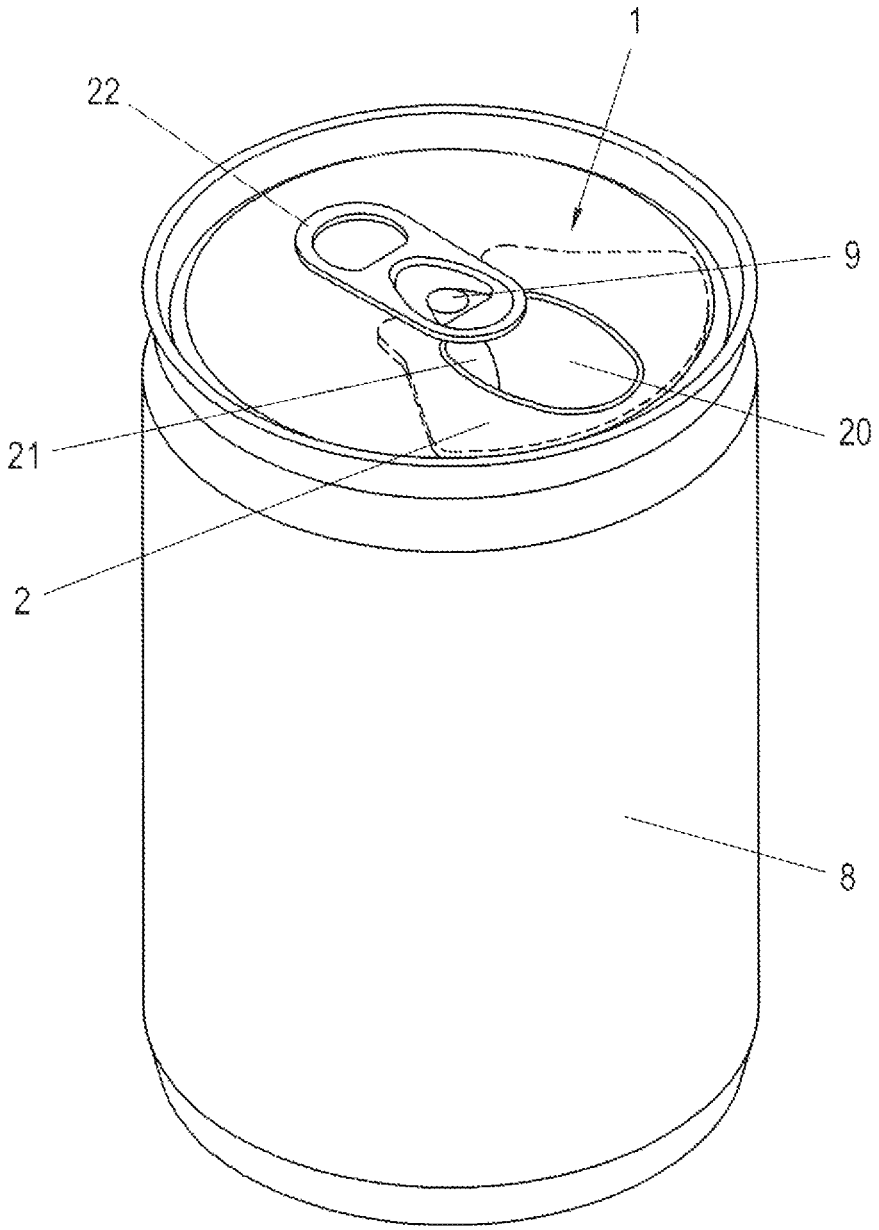

FIGS. 3A and 3B show, as partial sectional views along the line III-III in FIG. 1, two possibilities for obtaining different thicknesses for the fiat member; and FIG. 4 shows a pictorial view of a conventional aluminium beverage can with a drinking opening and a pull tab as well as a peg for fixing the pull tab, as well as—shown in dashed lines—a diagrammatic plectrum in accordance with FIG. 1 or FIG. 2 placed on this can, in order to obtain protection thereby in the manner of a cover for the drinking opening when the beverage can is not being used.

FIG. 1 shows a plectrum 1 with a flat body 2 which, completely generally (and not in the strict geometrical sense) has a configuration in the form of a circular sector in top view, wherein the inner face is broader compared with a circular sector and wherein the outer face 4 has a longer dimension in the circumferential direction compared with the inner face 3. The outer face 4 of the flat member 2 thus essentially has the shape of a circular arc.

A slotted opening 5 is provided on the inner face 3 of the flat member 2 which leads into an interior pivot bearing opening 6, whereby a constriction 7 is provided at the transition between the openings 5 and 6. When the plectrum 1 is being used as a protective cover for a beverage can 8, see FIG. 4, the pivot bearing opening 6 accommodates a peg 9 which is standard for beverage cans of this type, as will be explained below more in detail with reference to FIG. 4.

Accordingly, the pivot bearing opening 6 is approximately semi-circular in shape, preferably somewhat larger than a semi-circle, in order to form the constriction 7. The slotted opening 5 has lateral edges 10 which diverge with distance from the pivot bearing opening 6; however, it is also possible to envisage these borders 10 running in parallel lines, as can also be seen in FIG. 1, but in dashed lines for simplicity. Moreover, FIG. 2 shows, in dashed lines, that the borders 10' can also run in a divergent manner directly from the pivot bearing opening 6 without the need for the provision of a constriction 7.

As an example, the flat member 2 has straight lateral borders 11, 12 which—as can be seen in FIG. 2—enclose an angle $\alpha$. This angle $\alpha$, the sector angle of the circular sector, may, for example, be between 60° and 90°, preferably approximately 75° to 80°. As can be seen in FIGS. 1 and 2, the lateral borders are, for example, deflected outwardly from the inner face 3 at 13 so that in this manner, somewhat broader legs 14, 15 are obtained on the flat member 2 adjacent to the slotted opening 5. The deflection 13 begins approximately at the level of the pivot bearing opening 6.

In FIG. 1, the dashed lines 16 further illustrate that the plate member may be formed with two regions 17, 18 of different materials, an outer harder region 17 and an inner, softer region 18. A configuration of this type can readily be produced by injection moulding, wherein the same plastic base material is used for the whole flat member 2, but with different additives in the two regions 17, 18 which provide different hardnesses, as is known per se.

The dividing line 16 may additionally or alternatively also constitute a transition between a region 18' with a smaller thickness, for example 0.5 mm, compared with the other, outermost region 17' which, for example, may have a thickness of 0.6 mm. In this manner, the bottom surface may, for example, be continuous and in the region of the dividing line 16 the top surface has an appropriate step-like transition, as can be seen in FIG. 3B, or a change in levels may be present both on the top face and on the bottom face of the flat member 2, as can be seen in FIG. 3A.

Finally, FIG. 2 further shows that optionally, the flat member 2 may also be provided with a better grip for the fingers by providing strips 19, whereupon reinforcing strips may also be formed in this manner.

The beverage can 8 shown in FIG. 4 is formed in conventional manner with a cylindrical container body; an outlet opening 20 is provided on the top which in the original state is sealed by a sealing tab 21. This sealing tab 21 can, however, be pushed backwards with the aid of a tab 22 fixed to a peg 9, as can be seen in FIG. 4, so that the beverage can 8 can be opened and be ready for the contents to be drunk, for example with the aid of a drinking straw (not shown). The dashed lines in FIG. 4 further show a plectrum 1 covering the outlet opening or drinking opening 20, which is releasably fixed to the peg 9, in particular snap-fitted via its slotted opening 5 and pivot bearing opening 6 (see FIG. 1). The flat member 2 of the plectrum 1 may then be turned to the left or the right around the peg 9 in order to cover the opening 20 or expose it for drinking.

In practice, the present plectrum 1 can preferably be applied directly to beverage cans 8 when these are delivered from the manufacturers after filling. The flat body 2 may also optionally be used as an advertising medium, i.e. be printed or embossed with marketing material. When the contents of the beverage can 8 are to be drunk, the plectrum 1 is turned to one side in order to expose the sealing tab 21 which is then pushed inwards with the aid of the tab 22. The contents of the can 8 are then accessible. If the can 8 is not immediately emptied completely, then the flat member 2 can be turned to cover the opening 20 to act as a protective cover and to prevent the ingress of debris, or indeed insects, into the interior of the can. When the can 8 has been completely emptied and is to be disposed of, the plectrum 1 can be removed and, for example, be used for guitar playing.

The invention claimed is:

1. A plectrum comprising a flat member generally in the shape of a sector in top view, the flat member having an inner face as well as an outer face with a larger peripheral extent than the inner face in top view, wherein a slotted opening is provided on the inner face, said slotted opening leading into a pivot bearing opening, wherein the outer face and the inner face of the flat member are connected via first and second lateral edges, the first and second lateral edges having respective first tapering regions tapering inwards towards said slotted opening, wherein the plectrum comprises a first leg and a second leg, said slotted opening and said pivot bearing opening being disposed between the first leg and the second leg, wherein the flat member simultaneously forms a pluggable rotatable protective cover part for open beverage cans or the like, and wherein the flat member corresponds in top view to a generally circular sector with a sector angle between 60° and 90°, the sector angle being measured between the first tapering region of the first lateral edge and the first tapering region of the second lateral edge.

2. The plectrum as claimed in claim 1, wherein the outer face of the flat member is in the shape of a circular arc in top view.

3. The plectrum as claimed in claim 1, wherein the pivot bearing opening comprises a border which is approximately semi-circular in shape.

4. The plectrum as claimed in claim 1, wherein the slotted opening leads into the pivot bearing opening via a constriction in order to snap-fit it to a beverage can.

5. The plectrum as claimed in claim 1, wherein the slotted opening comprises lateral borders which run from the pivot bearing opening to the border of the inner face of the flat member in diverging or parallel lines.

6. The plectrum as claimed in claim 1, wherein following the first tapering regions the first and second lateral edges are angled outwards in the region of the pivot bearing opening.

7. The plectrum as claimed in claim 1, wherein the flat member is a member formed from two materials with different hardnesses.

8. The plectrum as claimed in claim 7, wherein a dividing line is provided between the two materials which runs from the first lateral edge to the outer face at an inclination.

9. The plectrum as claimed in claim 1, wherein the flat member comprises at least two regions of the member with different thicknesses.

10. The plectrum as claimed in claim 7, wherein the flat member is formed as an injection molded part.

* * * * *